US005756131A

United States Patent [19]

Suh

[11] Patent Number: 5,756,131

[45] Date of Patent: May 26, 1998

[54] CONTINUOUS BUILDING MATERIALS MOULDING DEVICE

[76] Inventor: Kun Hee Suh, Changmi Apt. A-1407, 40 Yoido-dong Youngdeungpo-gu, Seoul 150-010, Rep. of Korea

[21] Appl. No.: 446,757

[22] PCT Filed: Dec. 6, 1993

[86] PCT No.: PCT/KR93/00109

§ 371 Date: Jul. 19, 1995

§ 102(e) Date: Jul. 19, 1995

[87] PCT Pub. No.: WO94/13447

PCT Pub. Date: Jun. 23, 1994

[30] Foreign Application Priority Data

| | | | |
|---|---|---|---|
| Dec. 7, 1992 | [KR] | Rep. of Korea | 1992-23487 |
| Dec. 30, 1992 | [KR] | Rep. of Korea | 1992-26424 |
| Dec. 30, 1992 | [KR] | Rep. of Korea | 1992-26425 |

[51] Int. Cl.[6] ..... B28B 5/02

[52] U.S. Cl. ..... 425/442; 425/451; 425/453; 164/430

[58] Field of Search ..... 425/360, 348 R, 425/348 S, 259, 261, 442, 451, 453

[56] References Cited

U.S. PATENT DOCUMENTS

| | | | |
|---|---|---|---|
| 355,876 | 1/1887 | Lesneur | 425/451 |
| 868,730 | 10/1907 | Tubesing | 425/442 |
| 2,983,983 | 5/1961 | Mayer | 425/451 |
| 3,570,586 | 3/1971 | Lauener | 164/279 |
| 3,605,868 | 9/1971 | Giadorou | 164/279 |
| 4,017,247 | 4/1977 | Soukup et al. | 425/360 |
| 4,354,815 | 10/1982 | Bardsley et al. | 425/236 |
| 4,548,573 | 10/1985 | Waldstrom | 425/442 |

FOREIGN PATENT DOCUMENTS

| | | | |
|---|---|---|---|
| 1454514 | 10/1966 | France | 425/360 |
| 2565155 | 12/1985 | France . | |
| 3133290 | 3/1983 | Germany . | |
| 49-27509 | 3/1974 | Japan . | |
| 51-115522 | 10/1976 | Japan . | |
| 53-110621 | 9/1978 | Japan . | |
| 2-185404 | 7/1990 | Japan . | |

*Primary Examiner*—David W. Wu

*Attorney, Agent, or Firm*—Andrus, Sceales, Starke & Sawall

[57] ABSTRACT

A continuous moulding device for producing building materials includes two pairs of drive sprockets (22) oppositely positioned at the inlet and the outlet of the device, a pair of chain conveyors (24) wound on the drive sprockets (22), with each chain conveyor having a connecting part (24*a*) on each of its links. A series of bottom plates (26) are connected to opposite connecting parts (24*a*) of the links. Side wall members (27) are pivotably connected to the sides of each bottom plate to form a transverse unit mould, and end pieces (30, 30') are connected to each bottom plate (26) to resiliently contact the ends of the unit mould. The unit mould can also be formed by separate side wall members (127) and bottom members (128), or by integrally formed bottom walls (210*a*) and side walls (210*b*, 210*c*) defined by a moulding conveyor belt (210). The device is used to form moulded products such as concrete beams, door frames or aluminum blocks with a high degree of dimensional tolerances. The bottom wall can be provided with a pattern for forming a pattern on the moulded product, such as a natural wood grain.

34 Claims, 9 Drawing Sheets

Figure 2 A
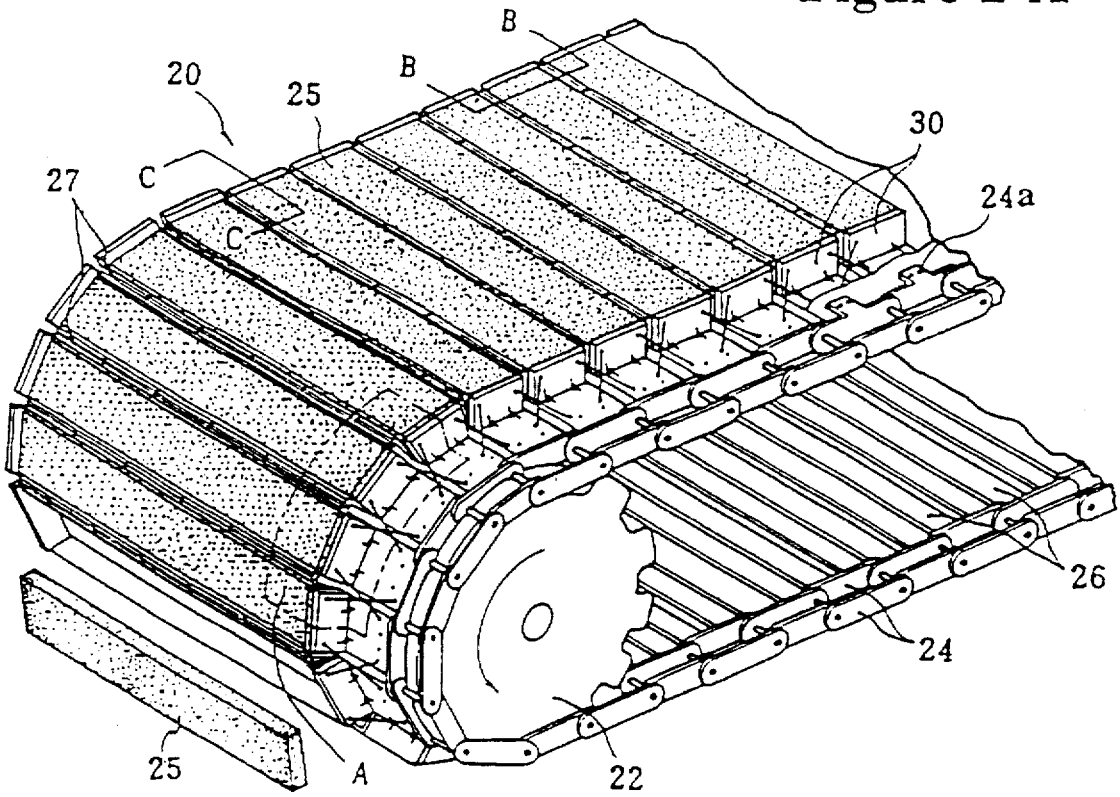
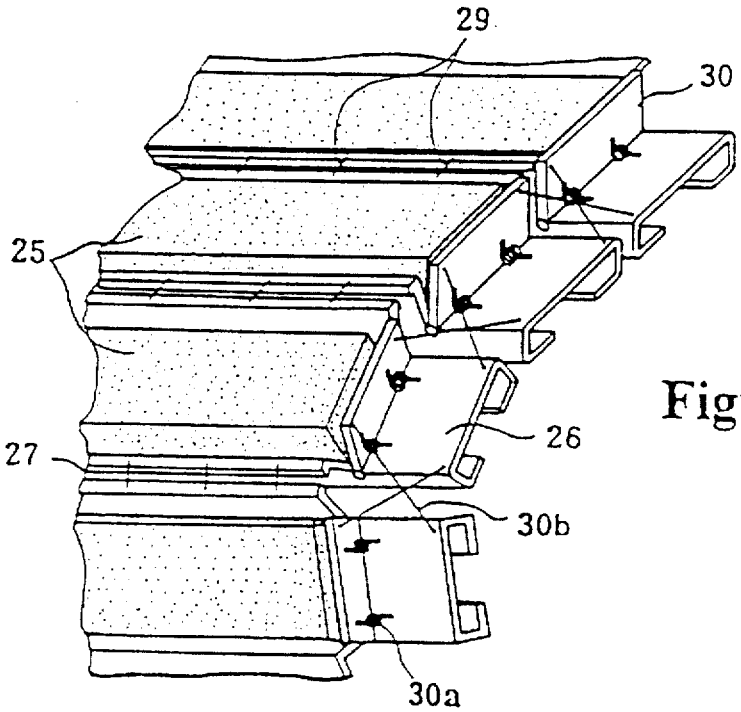
Figure 2 B

Figure 8 A
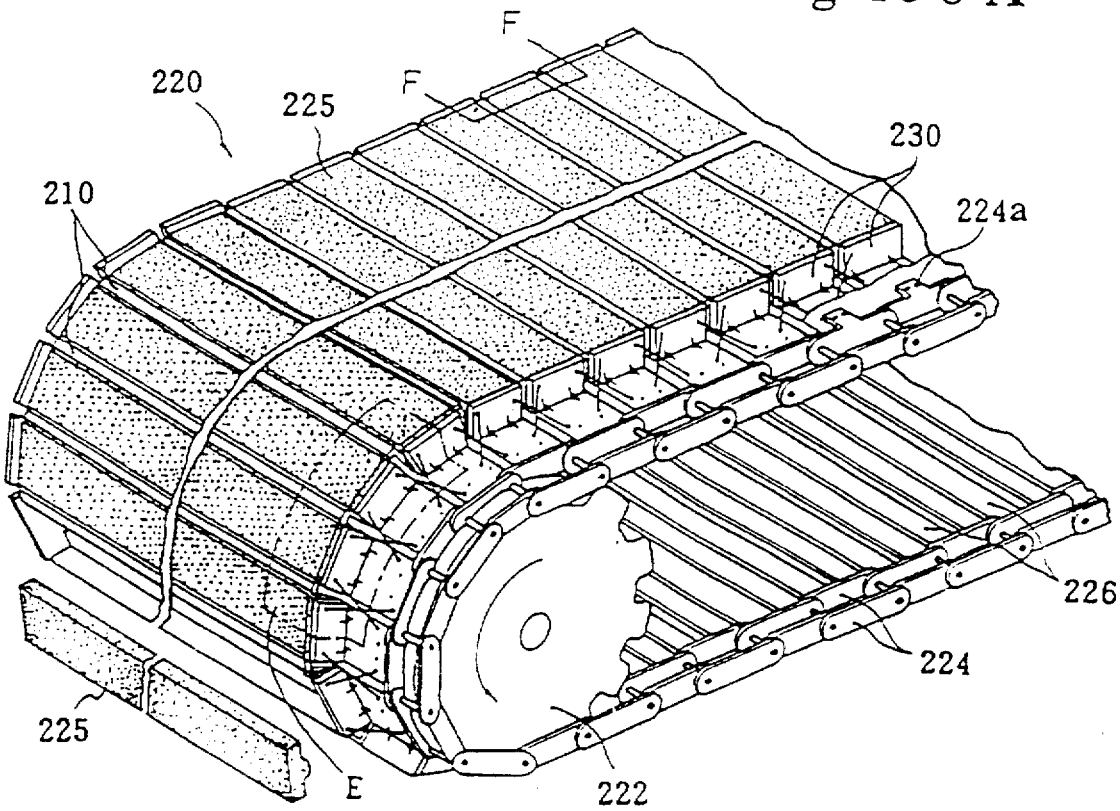
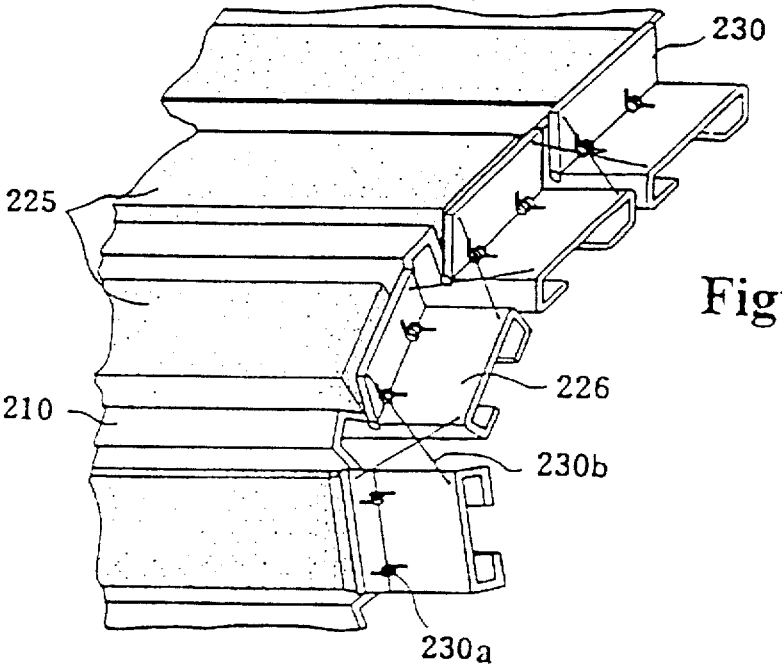
Figure 8 B

CONTINUOUS BUILDING MATERIALS MOULDING DEVICE

BACKGROUND OF THE INVENTION

The present invention relates to a moulding device of building materials, such as concrete beams or door frames, and aluminum blocks, using conveyor belt moulding frames. Particularly, the invention relates to a device capable of continuously moulding the materials as well as automatically removing them from the mould frames.

Numerous devices and methods for continuous moulding of building materials, such as wall plates and ceiling plates made of plaster or concrete have been proposed up to now.

Japanese Laid-Open (Unexamined) Patent Publication (sho) 53-110621 discloses a conveyor moulding system in which moulding material is poured through the conveyor inlet into the moulds of the conveyor, and hardened during progress, with the moulded product being removed from the moulds at the conveyor outlet where the drive roller rotates in a curved path, as illustrated in FIG. 1A. According to this reference, side conveyors 12 are installed at both sides of a moving conveyor 11 and moved at the same running speed as that of the moving conveyor 11. An L-shaped supply bath 14 having a flat portion 13 between the side conveyors 12 is installed above the moving conveyor 11. A plaster slurry having a viscosity of 10 to 100 poise from a line 15 is injected continuously into a moulding part of predetermined length consisting of the flat portion 13, the moving conveyor 11 and the side conveyors 12. The slurry in the supply bath 14 is maintained at almost a constant level, and the slurry is poured through an opening, which is provided in the flat portion 13 and has dimensions conforming to the products' dimensions, and is spread and hardened on the conveyor 11. After the slurry is hardened, the hardened products are removed from the moulds, cut, and then dried.

The above system can be used for the production of thin plates such as wall plates, ceiling plates, and so on. However, it cannot be used for the production of large door frames which have complex sectional structures and diverse dimensions. In addition, according to the above system, since the moulding frame is constructed by holding side conveyors 12 to both sides of the horizontal conveyor 11 tightly, the intersections between conveyors become square. Consequently, the above system can produce products having square corners as sharp as a blade, and also having seam portions; however it cannot be used to produce products such as door frames which require round edges.

In addition, Japanese Laid-Open (Unexamined) Patent Publication (sho) 49–27509 discloses a continuous moulding device and a method for manufacturing plates using a belt conveyor system, as illustrated in FIG. 1B. According to this reference, an integrated moulding frame 18 is installed on a conveyor 17 by inserting it between edges of the conveyor. The conveyor 17 is driven by the driving force of a rotating drum 16 and the moulding frame 18 can be bent repeatedly. The frame 18 is separated into several partitions by separating walls **18*a*, 18*b* and made of soft, resilient material. Plaster material 19 is filled in each partition of the moulding frame 18 and hardened during the conveyors' 17 movement. Then, each product 19*a* is automatically removed from the moulding frame 18 as the rotating drum 16** rotates.

In the above method, as the mating surfaces between the bottom of the hardened product **19*a* and the conveyor 17 are spaced from each other by the rotation of the rotating drum 16, the product is removed. However, in case of the removal of the hardened product from the separating walls 18*a*, 18*b* which separates the moulding frame into several partitions, since the detachment is forced, with the surfaces sliding on each other by the rotation of the rotating drum 16, use of the above method is impossible if the height of the separating walls 18*a*, 18*b*** must be high. Specifically, since the upper surfaces of high separating walls will rotate along a larger arc when being bent by rotation, the separating walls should be adequately extendable along the arc in order to rotate; if not, the walls will be misaligned with the conveyor making normal rotation practically impossible. In addition, if a wood grain moulding frame on which protruded points and lines are formed, is provided in the separating walls, the protruded points and lines are embedded into the product's surface when moulding the products. Therefore, the product's surface (protruding part), should be spaced vertically when the product is removed so that normal removal becomes possible. However, since in the above method, removal is done with the separating walls twisted, moulded wood grain finishes on the products are almost impossible and the detachment itself is practically impossible.

Furthermore, in such conveyor moulding systems, the moulding frame is constructed in the moving direction of the conveyor, that is, longitudinally. Therefore, when a product of narrow width (e.g., about 15 cm), and long length (e.g., about 2 m), such as a long beam and a door frame, is to be moulded, the length of the conveyor moulding system must be very long and the use of the system is impractical.

Therefore, although the prior art methods are appropriate for continuous moulding of thin plates such as wall plates and ceiling plates, the methods cannot be used for moulding building materials, such as door frames and window frames which have large dimensions and in which three-dimensional structures such as doorsills and grooves for roller rails are indispensable. Specifically, it is virtually impossible to apply the prior art methods in making better moulded finishes such as wood grains.

In addition, with the conventional methods according to the two Japanese references, a steel plate or a flat belt should be used. Therefore, when the volume and the weight of the building material to be moulded is large, a plurality of guide rollers supporting the belt are required and there is great difficulty in driving the belt only with driving rollers. To solve this problem, use of chain conveyors capable of transporting heavy articles may be considered. It is practically impossible, however, because when the links of the chain conveyors pass over drive rollers, the connecting portions between the links form a partial polygon instead of an arc resulting in the deformation of the mould itself and in cracks in the building material being moulded.

The prior art methods cannot be used in casting aluminum blocks. Up to now, aluminum blocks have been cast by individual casting frames, which is uneconomical due to waste of time and work.

BRIEF SUMMARY OF THE INVENTION

An object of this invention is to provide a continuous building materials moulding device which eliminates the problems and can continuously mould and automatically remove standard aluminum blocks as well as concrete beams or door frames.

Another object of the invention is to provide a moulding device, which can easily mould large building materials having wood grain surfaces and rounded edges, and/or by which hinge attaching means, recesses for door lock pins, and rails can be incorporated into the moulded products.

These objects can be accomplished by a continuous building materials moulding device according to the present invention, comprising two pairs of drive sprockets oppositely positioned at the inlet and the outlet of the device, a pair of chain conveyors wound on the drive sprockets and having a connecting part on each of their links, a series of bottom plates each of which is connected to opposite connecting parts of the links, side wall members pivotally connected to the sides of each bottom plate to form a unit mould transversely, and end pieces connected to each bottom plate to resiliently contact the ends of each unit mould.

The objects of the invention can be also accomplished by providing a continuous building materials moulding device comprising two pairs of drive sprockets oppositely positioned at the inlet and outlet of the device, a pair of chain conveyors wound on the drive sprockets and having a connecting part on each of their links, a series of bottom plates each of which is connected to opposite connecting parts of the links, side wall members and bottom members connected alternately to the bottom plates and respectively forming side walls and bottoms of unit moulds, and end pieces connected to each bottom plate to resiliently contact the ends of each unit mould.

The objects of the invention can also be accomplished by a continuous building materials moulding device comprising two pairs of drive sprockets oppositely positioned at the inlet and the outlet of the device, a pair of chain conveyors wound on the drive sprockets and having a connecting part on each of their links, a series of bottom plates each of which is connected to opposite connecting parts of the links, a moulding conveyor belt in which unit moulds are formed transversely and connected to each other, and end pieces connected to each bottom plate to resiliently contact the ends of each unit mould.

The invention allows the economic mass production of moulded parts because moulded parts are hardened in a short period moulding process, removed automatically, and do not need post processing.

In the continuous moulding device according to the invention, a unit mould is installed transversely on each pitch of the links of the chain conveyers driven by the sprockets.

The device makes it possible to maintain dimensional tolerances of the moulded products, concrete beams, door frames, or aluminum blocks, within ±1 mm, because, as described later, by suitable means, the side walls of each mould are positioned vertical with the bottom plates during moulding and automatically pivoted outward during removing. In addition, articles having a natural wood grain appearance can be produced by providing a separate bottom forming member on the bottom plate, the bottom forming member having on its surface desired wood grains embossed or engraved.

The end pieces are positioned removably at the ends of the unit mould of the device, which correspond to the upper and lower ends of door frames, aluminum blocks, etc. to be moulded. In case of moulding door frames, structures for receiving the tenons of the upper and lower door frame members i.e mortises are formed integrally with the end pieces or bottom plates. The integral end piece functions to separate moulded door frames by a given length automatically and facilitates assembling of the upper and lower door frame members. The members can be produced by the device of the invention.

BRIEF DESCRIPTION OF THE DRAWINGS

Embodiments of the invention are described below more fully in connection with the accompanying drawings. It should be understood that the invention is not confined to the embodiments. In the drawings:

FIG. 2A is a perspective view of the continuous building materials moulding device according to the first embodiment of the invention;

FIG. 2B is a partial enlarged perspective view of part A of FIG. 2A;

FIG. 8A is a perspective view of the continuous building materials moulding device according to the third embodiment of the invention;

FIG. 8B is a partial enlarged perspective view of part E of FIG. 8A;

DESCRIPTION OF THE PREFERRED EMBODIMENTS

Figure 1A:
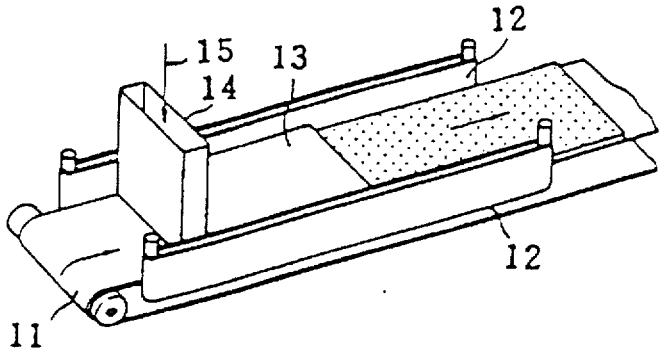
FIGS. 1A and 1B are perspective views of the continuous moulding devices of sheets according to prior art.

FIGS. 2A and 2B show a continuous moulding device 20 according to the first embodiment of the invention. The device comprises two pairs of drive sprockets 22 oppositely positioned at the inlet and the outlet of the device and rotated by a suitable drive means, a pair of chain conveyors 24 wound on the drive sprockets 22 and having a connecting part **24*a* on each of their links, a series of bottom plates 26 each of which is connected to opposite connecting parts 24*a* of the links, side wall members 27 pivotally connected to the sides of each bottom plate 26 to form a unit mould transversely, and end pieces 30 connected to each bottom plate 26 to resiliently contact the ends of each unit mould. Each component can be made of steel or stainless steel plates. The device 20** may be provided with known means, such as a moulding material supply device installed at the upstream end, a planing means such as a scraper or a roller to plane the upper surface of the moulding material (concrete) before hardening, and a hardening means to harden supplied moulding material (concrete). (In case of moulding aluminum blocks, planing means and hardening means are not needed, but a cooling means is needed instead.) Since these means are not included in the scope of the invention and are apparent to those skilled in the technical filed of the invention, they are not further explained in this specification.

Referring to FIG. 2, the drive sprockets 22 are positioned in pairs at the inlet and outlet of the device and each tooth of the drive sprockets 22 is engaged with each pivot axis of the link to drive the chain conveyor. The chain conveyors 24 have links spaced equally and is provided with connecting parts 24*a* protruding inwardly to the moulding frame. Such drive sprockets 22 and chain conveyors 24 are well known and are not explained further. The bottom plates 26 with the ends connected to the connecting parts 24*a* of the links of the chain conveyors 24 have semihollow-shaped sections. Observing the continuous moulding device 20 as a whole, the drive sprockets 22 are oppositely positioned in pairs at the front and rear ends of the device 20, the chain conveyors 24 with the connecting parts 24*a* directed inward are wound on the front and rear drive sprockets 22, and the semihollow bottom plates 26 are positioned between opposite connecting parts 24*a*. The shape of the bottom plate is not limited to the semihollow-shaped section and may be simply flat or of a channel shape.

Figure 3:
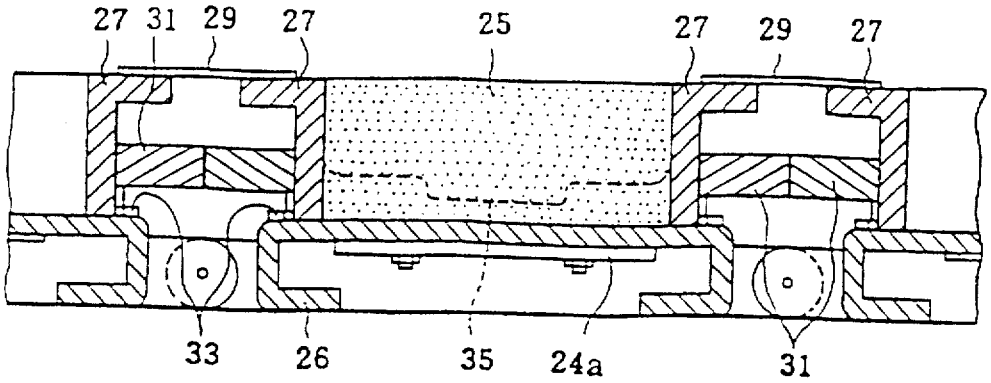
FIG. 3 is a sectional view taken along the line B—B of FIG. 2.

Now, the unit mould of the continuous moulding device is explained with reference to FIG. 3. As shown in FIG. 3, the unit mould of the continuous moulding device 20 comprises one bottom plate 26 and two side wall members 27 positioned vertical with the bottom plate 26 during moulding and outwardly pivotable during removing. Each side wall member 27 is connected pivotally with hinges 33 to the bottom plate 26. One side of the hinge 33 is connected to the bottom plate 26 and the other side is connected to the side wall member 27. The hinge cannot be open more than 90° and spacers 31 are provided between adjacent side wall members 27. Therefore, when moulding, the side wall member 27 is prevented from pivoting by the hinge 33 inside the mould and by the 15 member 27 is maintained and the side wall member 27 is maintained vertically with the bottom plate 26.

Adjacent side wall members 27 are connected each other by resilient connecting wires 29. By such construction, as shown in FIGS. 2A and 2B, when the unit mould passes the outlet of the continuous moulding device, that is, the links of the chain conveyor 24 move over the drive sprocket 22, the links are pivoted about their pivot axes, and the distance between the upper ends of the adjacent side walls of the moulded products is increased. But since the side wall members 27 connected by connecting wires 29, the side wall members 27 are pivoted outward from the side wall of the moulded product 25. That is, removal of the moulded product from the mould is done automatically. The resilient connecting wires 29 can be replaced by cloth or rope of unwoven fabric or leather.

Figure 4:
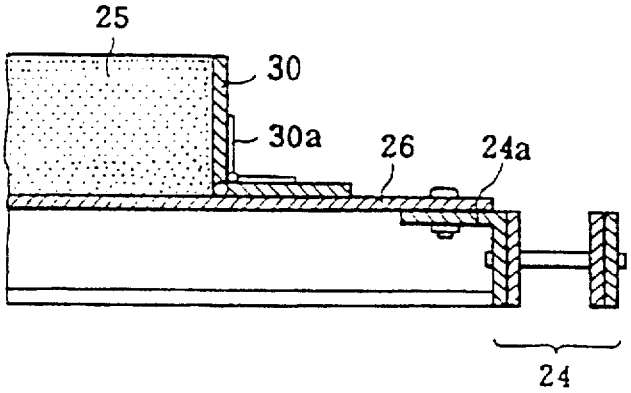
FIG. 4 is a sectional view taken along the line C—C of FIG. 2.

As shown in FIGS. 2A and 2B, and FIG. 4, the end pieces 30 are attached on the bottom plate 26 to be in close contact with the ends of the unit mould of the continuous moulding device The end piece 30 has the shape of a hinge and one side is fixed on the bottom plate 26 while the other side is biased by springs 30*a* to be in contact with the ends of the side wall members 27. One end of each wire 30*b* is connected to one of the upper corners of the other side of the end pieces 30 and the other side of each wire is connected to the adjacent bottom plan 26. The length of the wire 30*b* is determined not to pull the end piece 30 when the bottom plate 26 moves on a plane. But, as shown in FIGS. 2A and 2B, when the bottom plate 26, or the chain conveyor 24 moves over the drive sprockets 22, adjacent bottom plates are slanted with each other and the wires 30*b* are pulled. Accordingly, the end pieces are pivoted outward and separated from the moulded product 25. As described before, the side wall member 27 is separated from the moulded product 25 when the chain conveyor 24 moves over the drive sprocket. Therefore, as shown in the left of FIG. 2A, the whole moulded product is removed automatically from the mould and drops to a suitable transport means provided at the outlet.

Figure 5:
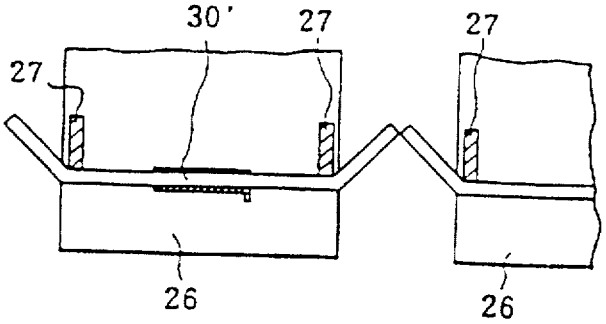
FIG. 5 is a plan view showing another embodiment of the end pieces.

FIG. 5 shows another embodiment of the end pieces. The end pieces 30 shown in FIG. 2A to FIG. 4 are flat. But the end piece 30' shown in FIG. 5, comprises a body contacting the end surface of the side wall member 27, and two wings bent inward by 30° to 40°. With this construction, when the side wall members 27 are pivoted at the outlet, the upper corner of the side wall member pushes the upper portion of the wing of the end piece 30', and the end piece 30' is pivoted about its pivot axis and spaced from the moulded product 25, i.e, separation is done automatically. Therefore the separate wires 30*b* need not be provided in this embodiment.

The above-described continuous moulding device can mould aluminum beams and concrete beams. The device can also mould door frames by attaching an auxiliary door frame moulding member 35 to the bottom plate by adhesive, etc. Since the door frame moulding member 35 is usually made of hard rubber, etc., a wood grain moulding member may be constructed by forming patterns comprising dots and lines. In addition, it will be understood that a door frame with 3 wood grain surfaces can be moulded by attaching such a wood grain moulding member to the inside of the side wall member 27.

Figure 6A:
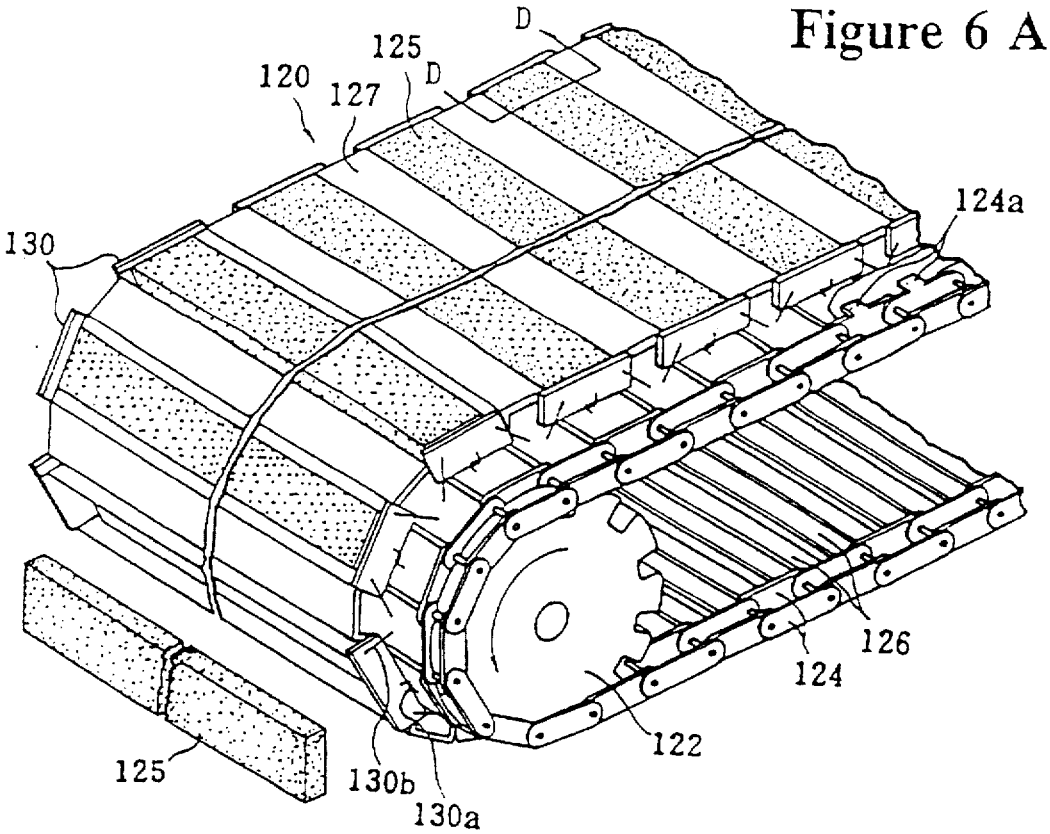
FIG. 6A is a perspective view of the continuous building materials moulding device according to the second embodiment of the invention.
Figure 6B:
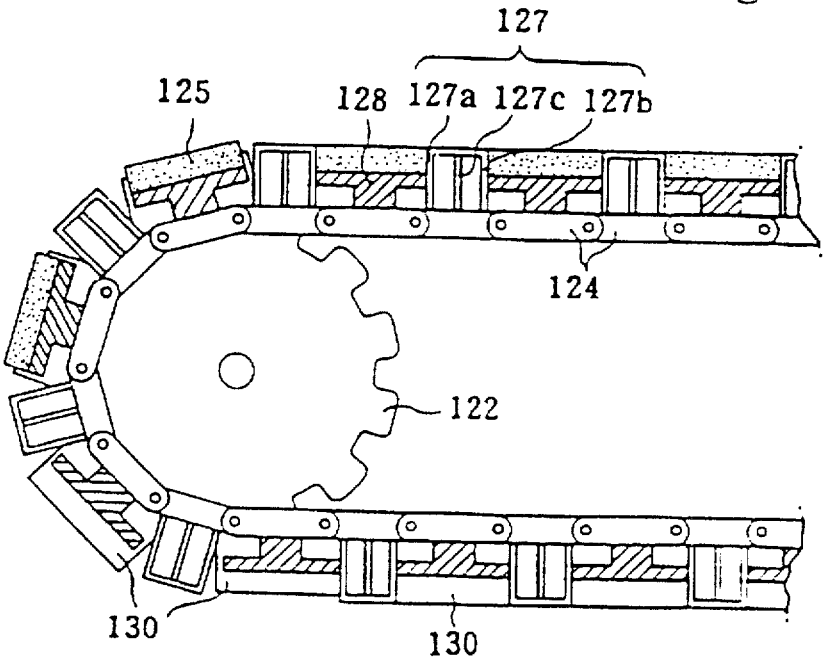
FIG. 6B is a longitudinal sectional view of FIG. 6A.

FIGS. 6A and 6B show a continuous moulding device 120 according to the second embodiment of the invention. The device 120 comprises two pairs of drive sprockets 122 oppositely positioned at the inlet and the outlet of the device and rotated by a suitable drive means, a pair of chain conveyors 124 wound on the drive sprockets 122 and having an connecting part 124*a* on each of their links, a series of bottom plates 126 each of which is connected to opposite connecting parts 124*a* of the links, a series of side wall members 127 and bottom members 128 attached alternately to the bottom plates 126 and forming the side walls and bottoms of the unit moulds transversely, and end pieces 130 connected to each bottom plate 126 to resiliently contact the ends of each unit mould. Each component can be made of steel or stainless steel plates. As in the first embodiment, the continuous moulding device 120 according to the second embodiment may be provided with known means, such as a moulding materials supply device installed at the upstream end, a planning means such as a scraper or a roller to plane the upper surface of the moulding material (concrete) before hardening, and a hardening means to harden supplied moulding material (concrete).

These known means are not explained further for the same reason as that of the first embodiment. In addition, the drive sprockets 122 and the chain conveyors 124 are not further explained since their constitution and operation are the same as those of the drive sprockets 22 and the chain conveyors 24 of the first embodiment.

The side wall members 127 and bottom plates are explained with reference to FIGS. 7A and 7B.

Figure 7A:
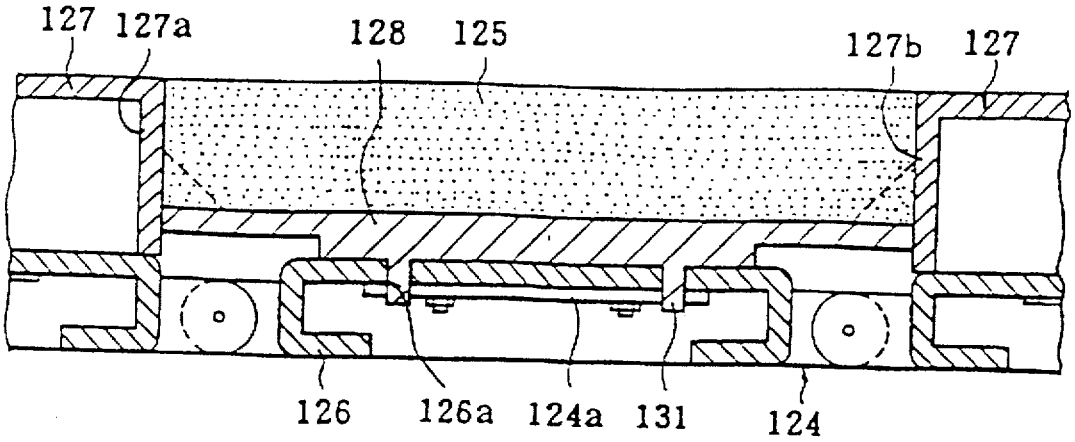
FIG. 7A is a sectional view taken along the line D—D of FIG. 6A.

FIG. 7A shows the unit mould of the continuous moulding device of the invention comprising the side wall members 127 and the bottom member 128. The side wall member 127 is a rod having a channel-shaped section and is fixed to the bottom plate 126 by welding, etc. The side wall member 127 may be provided with reinforcing members 127*c* at its center as shown in FIG. 6B. In this embodiment, the side wall member 127 has a channel-shaped section and is fixed by welding, etc. But, if desired, it may have a semihollow shape and fixed on the bottom plate 126 by bolting, etc. The bottom member 128 is fixed on the upper surface of the bottom plate 126 by suitable means. This fixing means comprise bolts 131 formed integrally with the bottom member 128 on the lower protruding surface of the bottom member 128 in at least two rows, and nuts (not shown) engaging with the bolts 131. The bolts 131 pass through bolting holes 126*a*. It should be noted that the dimensions and number of the bolts and bolting holes are not confined to the described example; all that is required is for the bottom plate and the bottom member 128 not to separate. This embodiment is intended to mould beam shaped products such as beams or blocks made of concrete or aluminum. Therefore, it can be understood that aluminum blocks having gambrel-shaped sections can be moulded by installing triangular beams at the sides of the bottom member 128 as shown in dotted lines in accordance with the shapes of the beams or blocks.

Figure 7B:
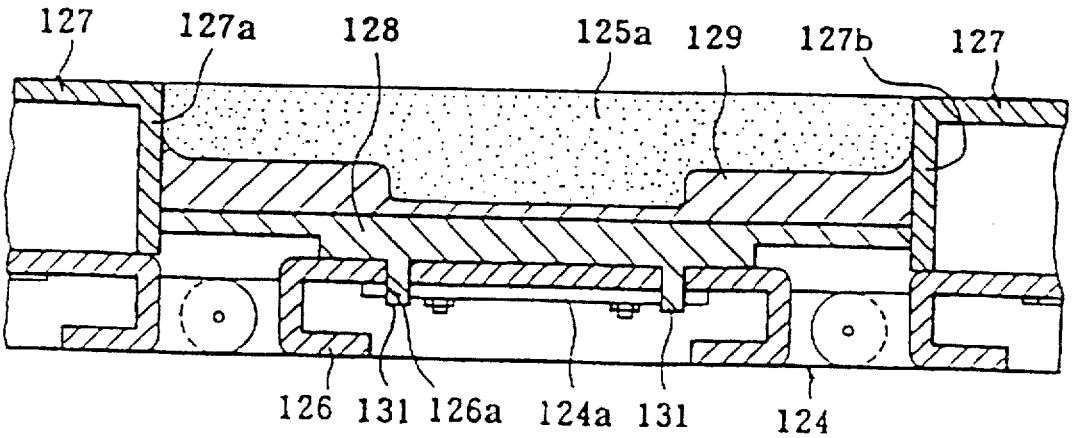
FIG. 7B is a view similar to FIG. 7A showing a structure for forming door frames.

FIG. 7B shows another embodiment for moulding door frames 125*a*. The constitution of this embodiment is similar to that shown in FIG. 7A, but different in that a second bottom member 129 made of rubber, etc. is closely attached to the upper surface of the bottom member 128. Attaching the second bottom member 129 to the bottom member 128 can be done by using adhesives, bolts, rivets, etc. In addition, patterns for reproducing wood grain on the surface of the moulded product, i.e., the door frame, can be embossed or engraved. If desired, separate side wall forming members made of rubber may be attached to the side wall members 127 to make door frames having three wood grain surfaces.

Returning to FIGS. 6A and 6B, the side walls 127*a*, 127*b* of the side wall members 127 are positioned vertically when forming moulds and outwardly pivot at the outlet of the moulding device to remove the moulded product 125. When the chain conveyors 124 move over the drive sprockets 122, the side walls 127*a*, 127*b* of the side wall member 127 pivot around the pivot axes of the links of the chain conveyors 124 about the bottom members 128 or the second bottom members 129. Therefore, normal removal is possible when the unit moulds are wood grain moulds with patterns comprising lines and dots.

As shown in FIGS. 6A, 6B, and 7B, the mould for forming each door frame 125*a* comprises the second bottom member 129 and two side wall members 127 positioned vertically, and two end pieces 130 positioned at the ends of two side walls. The second bottom member 129 and the side wall members 127 make right angles when moulding, but rounded edges are formed by the second wall member and the two side wall members so that rounded edges of the moulded produce can be formed. This is an important advantage of the invention over Japanese Laid-Open Patent Publication (sho) 53-110621, which cannot form rounded edges. Therefore, the moulded product according to the invention i.e., the door frame, has improved safety against accidental collisions against the edges by children or the elderly and the weak. In addition, by suitable construction of the second bottom member 129, the bottom surface of the second bottom member can be provided with hinge attaching means for installing a hinge type door at the moulded concrete door frame and/or a recess for receiving a door lock pin.

The constitution and operation of the end pieces 130 are the same as the end pieces 30 of the first embodiment and are not explained further.

FIGS. 8A and 8B show a continuous moulding device 220 according to the third embodiment of the invention. Among the components of this embodiment, two pairs of drive sprockets 222, a pair of chain conveyors 224, a series of bottom plates 226, and the end pieces 230, 30' are the same in their constitution and operation as those of the first and the second embodiments. However, the unit moulds of this embodiment are different from those of the first and the second embodiments in that they are formed in a conveyor belt 210 made of highly flexible and resilient materials. In addition, connecting parts 244*a* of the chain conveyors 224, moulded products 225, springs 230*a*, and wires 230*b* are the same as those of the first and the second embodiments and are not explained further.

Figure 9A:
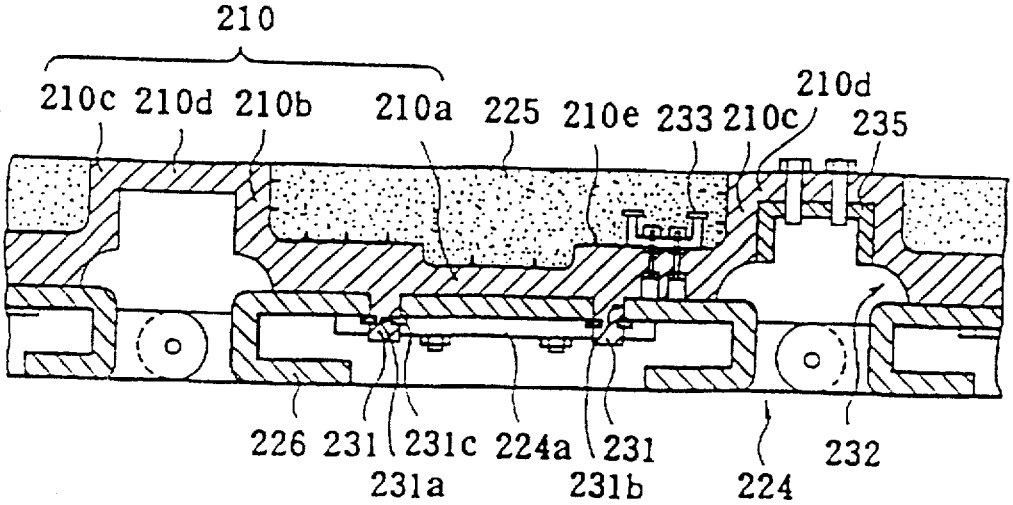
FIG. 9A is a sectional view taken along the line F—F of FIG. 8A.
Figure 9B:
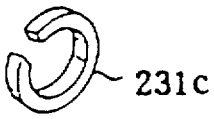
FIG. 9B is a perspective view of the retainer.

Referring now to FIG. 9, the structure of the moulding conveyor belt 210 will be explained below. As shown in FIG. 9A, the unit mould of the moulding conveyor belt 210 comprises a bottom wall 210*a*, and two side walls 210*b* which can be bent with respect to the bottom wall 210*a*. The unit moulds are joined by joining parts 210*d* at the side walls. The unit moulds can be made individually, or any number of unit moulds can be made integrally to have the above-described construction. Joining parts 210*d* of the unit moulds which are made individually or integrally, are joined to each other by support members 235, FIG. 10 as explained below. However, it can be understood that they can be joined to each other by using appropriate means, such as adhesives, etc., other than the support members. Also, the unit moulds are fixed tightly on the upper surface of each bottom plate 226 by a suitable means. Such a means for fixing the unit mould tightly comprises: protrusions 231 formed integrally with the lower surface of the bottom wall 210*a* of the moulding conveyor belt 210 in at least two rows; grooves 231*a* for receiving retainers; holes 231*b* provided in the bottom plates 226 for the protrusions; and retainers 231*c*, FIG. 9B inserted into the grooves 231*a* of the protrusions. The protrusions 231 pass through the holes 231*b*. It should be noted that the dimensions and number of the protrusions and the holes are not confined to the described example; all that is required is for the bottom plates 226 and the moulding conveyor belt 210 not to separate when moulding. Insertion of the retainers 231*c* into the grooves 231*a* of the protrusions 231 facilitates the attachment of the protrusions 231. Consequently, the moulding conveyor belt 210 can be attached closely and removably onto the upper surface of the bottom plates 226. The way of attaching the moulding conveyor belt 210 onto the bottom plates 226 is not confined to the above but may be accomplished by using adhesives, bolts, rivets, etc. In addition, patterns 210*e*, for simulating wood grain on the surface of the moulded product, can be embossed or engraved on the inner surfaces (the bottom wall and the side walls) of the moulding conveyor belt.

Figure 10:
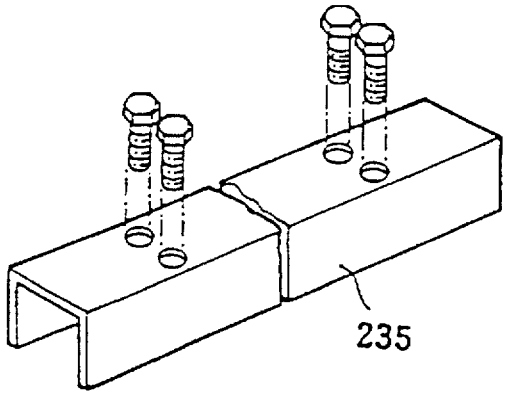
FIG. 10 is a perspective view of the support member.

Referring again to FIGS. 8 and 9, the side walls 210*b*, 210*c* of the moulding conveyor belt 210 are positioned vertically when forming moulds and are bent with respect to the moulded product 225 at the outlet of the device to remove the moulded product 225. In addition, round-cut edges 232, shaped as a quarter circle, are formed longitudinally along the outer and lower edges of the moulding conveyor belt 210. Preferably, the cut edges 232 maintain adequate thickness so that they do not collapse due to the weight of the side walls 210*b*, 210*c*. The cut edges 232 facilitate the outward bending of the side walls 210*b*, 210*c* of the moulding conveyor belt 210 with respect to the bottom wall 210*a*. Consequently, the side walls 210*b*, 210*c* are separated almost vertically from the surface of the hardened product. Therefore, normal removal is possible even when the moulds of the moulding conveyor belt 210 has a wood grained finish on which patterns comprising lines and dots are formed. By this construction, when the chain conveyors 224 move over the drive sprockets 222, the links of the chain conveyors 224 pivot about their pivot axes, and the distance between the side walls of the moulded product is increased; and the flexible side walls of the moulding conveyor belt are bent away from the side walls of the moulded product 225. In addition, the support members 235 are fitted in the joining parts 210*d* of the side walls. As shown in FIG. 10, the support member 235 is a long channel-shaped rod. The support members not only join the joining part 210*d* of the unit mould of the moulding conveyor belt 210, attached on the bottom plate 226, with the joining part of the adjacent unit moulds, but also prevent the side walls 210, 210*c* from bending outward by the weight of moulding material when the chain conveyors 224 move horizontally. The support members 235 are fixed to the joining parts 210*d* only on their upper parts by bolts.

As can be seen from FIGS. 8 and 9, in the third embodiment, the mould for forming the moulded product 225 comprises the bottom wall 210*a* of the moulding conveyor belt 210, the two side walls 210*b*, 210*c* positioned vertically, and the end pieces 230 positioned at the ends of the side walls. The integrally formed bottom wall 210*a* and two side walls 210*b*, 210*c* are positioned orthogonally when moulding but the edges formed by the bottom wall and the two side walls are rounded in order to mould products having rounded edges. This is an important advantage of the invention over Japanese Laid-Open Patent Publication (sho) 53-110621 which cannot form rounded edges. Therefore, the moulded product according to the invention, i.e., the door frame, has improved safety against accidental collisions against the edges by children or the elderly and the weak. In addition, as described below, the bottom surface of the moulding conveyor belt 210 can be provided with hinge attaching means for installing a hinge type door at the moulded concrete door frame and/or a recess for receiving a door lock pin.

Figure 11:
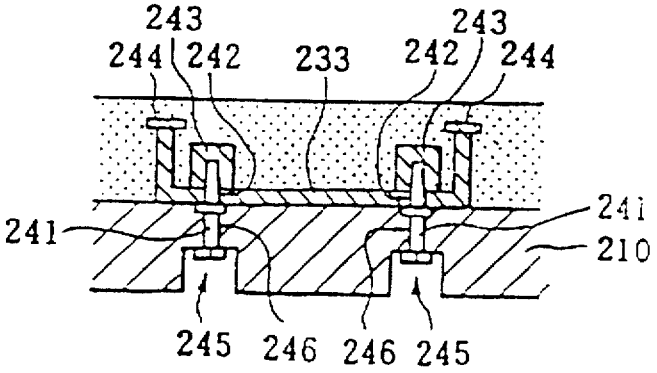
FIG. 11 is a partial enlarged view of the hinge attaching means.

As shown in FIGS. 9 and 11, attaching means 233 for attaching hinges for installing doors at the concrete door frame can be embedded in the door frame during moulding. Referring to FIG. 11, at first, resilient pins 241 are fixed at pre-determined points of the moulding conveyor belt 210 in a pre-determined arrangement so that the pins 241 penetrate the belt 210 from the outer lower surface to the inside of the mould and the hinge attaching means 233 are fitted in their screw holes 242 with the pins 241. The screw holes 242 are aligned with the screw holes of the hinges to be attached and the arrangement of the pins 241. The hinge attaching means are provided on their back surface with pin holders 243 into which the pins 241 are inserted and anchors 244 for fixing the means firmly into the concrete. The resilient pins 241 may be replaced by metal pins, and in this case the pin holders 243 may be resilient bodies. The pins 241 supporting the hinge attaching means 233 can be inserted through the recess 245 provided in the lower surface of the moulding conveyor belt 210 and the pin inserting holes 246 provided in the moulding conveyor belt 210. As shown in FIG. 11, after the hinge attaching means 233 are fitted with the pins 241 and the pin holders 243 are fitted to the protruded ends of the pins 241, concrete mortar is injected into the mould and hardened. Then, when removing the moulded product, the pins 241 easily come out from the hinge attaching means 233 and the hinge attaching means 233 with their anchors 244 embedded are fixed firmly to the moulded product, i.e., the door frame. Therefore, hinges are easily assembled by screwing them to the screw holes 242 of the hinge attaching means 233. Recesses for receiving latch pins of door locks can be provided similarly.

Figure 12A:
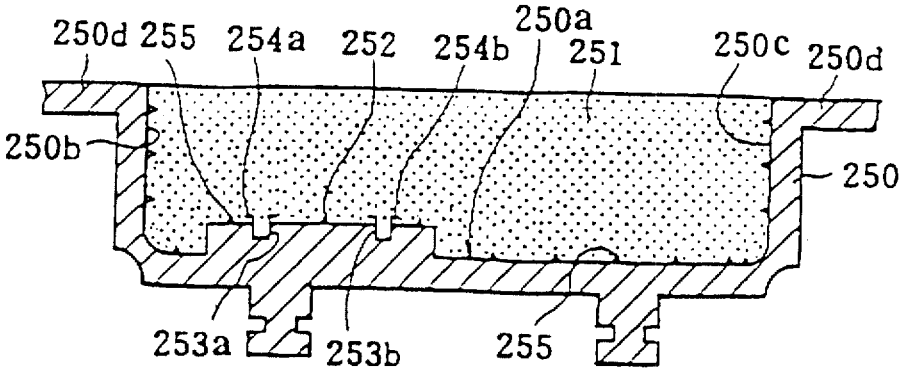
FIG. 12A is a sectional view of the modified door frame mould.
Figure 12B:
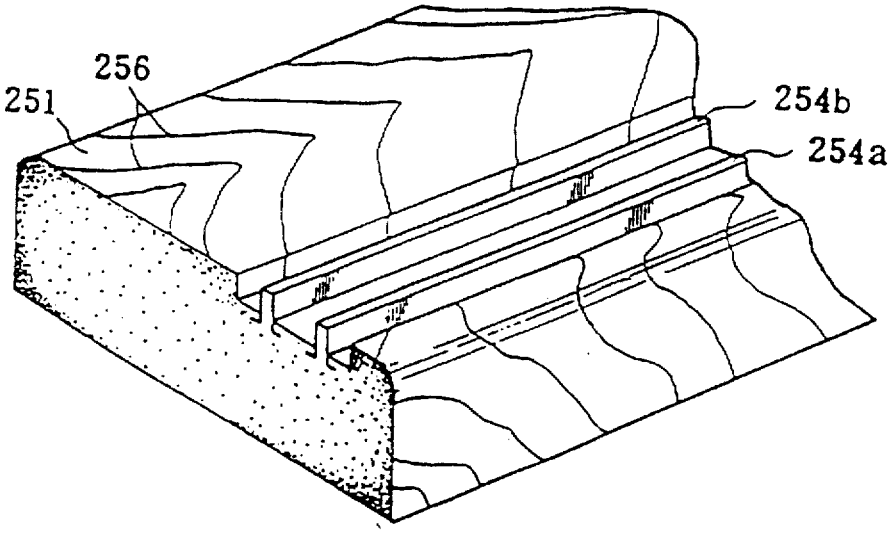
FIG. 12B is a perspective view of the door frame moulded by the mould of FIG. 12A.
Figure 12C:
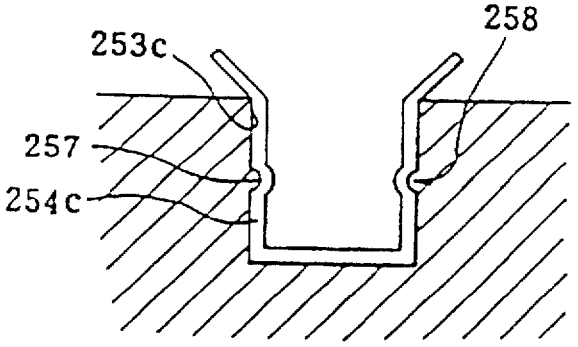
FIG. 12C is a sectional view of the modified groove for assembling rails.

FIGS. 12A to 12C are sectional views of a modified embodiment of the moulding conveyor belt. As the moulding conveyor belt 210 shown in FIGS. 8 and 9, the moulding conveyor belt 250 shown in FIG. 12A comprises a bottom wall 250*a* and two side walls 250*b*, 250*c* which can be bent with respect to the bottom wall 250*a*. The basic structure of the unit moulds of the moulding conveyor belt 250 is the same as that of the moulding conveyor belt 210 in that they are joined at their side walls by joining parts 250*d*, but they are primarily for moulding door frames for sliding doors. The shape of the lower section of the moulding conveyor belt 250 is the reverse of the lower part of the door frames to be moulded. FIG. 12 shows two grooves 253*a*, 253*b* for assembling rails provided on the elevated portion 252 of the bottom wall 250*a* of the moulding conveyor belt 250. The moulds are constructed to insert rails 254*a*, 254*b* into the grooves 253*a*, 253*b* before injecting concrete mortar into the mould. In addition, as shown in FIG. 12A, small protrusions 255 comprising protruding lines and dots forming wood grain are provided on the inner surfaces of the mould of the moulding conveyor belt 250 to form wood grain 256 on the moulded product 251. It should be understood that although only two rails 254*a*, 254*b* are shown in FIG. 12B, in general four rails can be attached.

Another embodiment of a rail 254*c* and a groove for assembling rails 253*c* is shown in FIG. 12C. Protrusions 257 are provided at the two side walls of the groove 253*c* and recesses 258 are provided at the two side walls of the rail 254*c* for receiving the protrusions 257. Accordingly, the groove 253*c* and the rail 254*c* of FIG. 12*c* are combined more firmly than the grooves 253*a*, 253*b* and the rails 254*a*, 254*b* of FIGS. 12A and 12B and are more stable when injecting concrete.

The end pieces 30, 30', 130, 230 have been described to be flat. But it can be understood that in case of a door frame, additional end pieces may be formed integrally at the positions corresponding to the upper and lower ends of the door frame in order to receive the tenons of the upper and lower door frame members i.e., to form mortises, or the additional end pieces may be formed integrally with the bottom plates 26, 126, 226 in front of the end pieces 30, 30', 130, 230.

As can be understood from the above, the unit moulds of the continuous moulding devices 20, 120, 220 of the invention are formed perpendicular to the moving direction, i.e., transversely. Therefore, the invention can substantially reduce the length of the continuous moulding device 20, 120, 220, which moulds long and narrow building materials such as beams or door frames, as compared to the known device. For example, in case of moulding beams or door frames having a width of 15 cm and a length of 200 cm, since the known device moulds longitudinally, if a moulding device 10 m long and 20 to 30 cm wide is used, only approximately five usable moulds result.

However, by the continuous moulding device 20, 120, 220 of the invention, since the moulds are formed transversely, and considering the width and clearance of each mould, the longitudinal length occupied by one mould in the moulding device is above 20 cm. Therefore the number of usable moulds amounts to about 50.

Consequently, productivity is enhanced by a factor of approximately ten when compared with the known device.

Figure 1B:
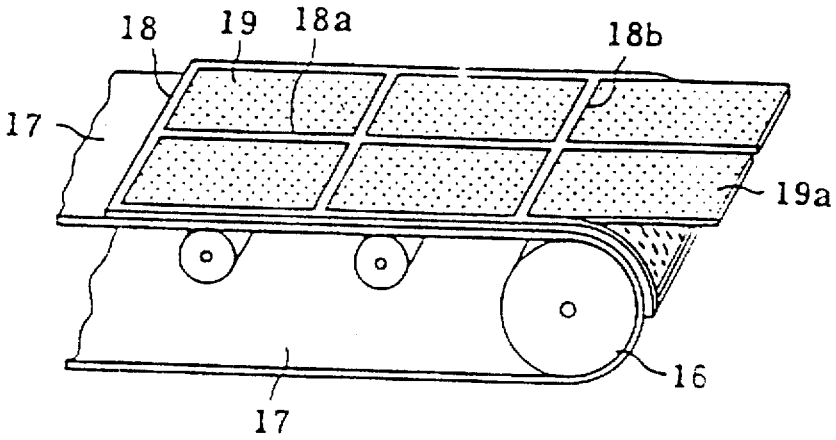

In addition, as described with reference to FIGS. 1A and 1B, the known conveyor belt type moulding device uses a steel conveyor belt below the moulding conveyor belt forming moulds, but steel conveyor belts are expensive and not suitable for transferring heavy articles. But since the invention uses the semihollow-shaped bottom plates 26, 126, 226 which have far better strength than steel conveyor belts, and support each unit mould individually, and since the chain conveyors 24, 124, 224 and the drive sprockets 22, 122, 222 are stable and can transfer a much larger driving force than the conventional device, the mould is stable and heavy products can be transferred without difficulty.

Although the above embodiments describes mainly the moulding method of moulding products 25, 125, 125*a*, 225, 251, i.e., concrete beams and door frames, and aluminum beams and blocks, it can be understood that other building materials such as interior and exterior decorative materials for buildings, and materials for landscape architecture having the shape of a beam and a suitable pattern reproduced thereon, can be manufactured by the invention.

The compositions of the moulding materials are known and various kinds of materials can be used. Aluminum blocks can be moulded by using fused aluminum as the moulding material. In addition, as a different material, the mixture of portland cement and sand (diameter 1 to 3 mm) by weight ratio 1:3 is mixed with water and with a small amount of vinyl acetate-ethylene copolymer additive, with the resulting mixture being used for moulding concrete products. Another example is a thermosetting resin mortar which is used for interior and exterior decorative materials. The thermosetting resin comprises phenol resin, urea resin, epoxy resin, or unsaturated polyester resin. Another example is foamed plaster slurry made by agitating and forming bubbles in a mixture of 24 kg of water, 0.6 kg of polyvinyl alcohol, and 40 kg of sodium lauryl sulfate, and adding 20 kg of plaster and 1.2 kg of asbestos. The material is used as an interior decorative material.

The hardening rate of the moulding materials is set preferably as fast as possible considering the operational efficiency, and is set at about 10 minutes by adjusting the composition. Such compositions are known and are not explained further.

According to the invention, in addition to the products described, other moulding product having various shapes, e.g., octagonal beams, can be moulded.

We claim:

1. A continuous moulding device of building materials comprising two pairs of drive sprockets (22) oppositely positioned at the inlet and the outlet of the device, a pair of chain conveyors (24) wound on said drive sprockets (22) and defining a forming run between the drive sprockets, the chain conveyors having a connecting part (24*a*) on each of their links, a series of bottom plates (26) each of which is connected to opposite connecting parts (24*a*) of said links, wherein each bottom plate defines spaced sides, a side wall member (27) pivotally connected to one of the sides of each said bottom plate to form a unit mould transversely, wherein each side wall member is pivotable relative to the bottom plate to which the sidewall member is connected, between a forming position on the forming run of the chain conveyors and a release position at the outlet of the device, end pieces (30, 30') movably connected to each said bottom plate (26) to contact the ends of each unit mould, wherein said end pieces extend between the side wall members of each unit mould and are movable relative to the bottom plate to which they are connected between a forming position and a release position, wherein the side wall members and end pieces are in their forming positions on the forming run of the chain conveyors and are movable to their release positions as the chain conveyors are moved about the drive sprockets to release engagement with a product formed in said unit mould.

2. A continuous moulding device of building materials comprising two pairs of drive sprockets (22) oppositely positioned at the inlet and the outlet of the device, a pair of chain conveyors (24) wound on said drive sprockets (22) and defining a forming run between the drive sprockets, the chain conveyors having a connecting part (24*a*) on each of their links, a series of bottom plates (26) each of which is connected to opposite connecting parts (24*a*) of said links, wherein each bottom plate defines spaced sides, a side wall member (27) pivotally connected to one of the sides of each said bottom plate to form a unit mould transversely, wherein each side wall member is pivotable relative to the bottom plate between a forming position on the forming run of the chain conveyors and a release position at the outlet of the device, end pieces (30, 30') connected to each said bottom plate (26) to contact the ends of each unit mould, wherein said end pieces extend between the side wall members of each unit mould and are movable between a forming position and a release position, wherein the side wall members and end pieces are in their forming positions on the forming run of the chain conveyors and are movable to their release positions as the chain conveyors are moved about the drive sprockets to release engagement with a product formed in said unit mould, and wherein each said side wall member (27) is connected to the bottom plate (26) with hinges (33), and wherein adjacent side wall members (27) define upper parts connected to each other by connecting wires (29), and further comprising spacers (31) attached to an outside surface defined by each said side wall member (27) to maintain a constant distance relative to the adjacent side wall member.

3. The device according to claim 2 wherein said end pieces (30, 30') are in the form of a hinge and are attached on the bottom plate (26) and are biased by resilient springs (3O*a*) to be in close contact with ends defined by the side wall members (27).

4. The device according to claim 3 wherein wires (30*b*) are provided to automatically move said end pieces (30) at the outlet of the device to their release positions, wherein one end of said wire is connected to the adjacent bottom plate (26) and the other end of said wire is connected to an upper corner defined by the end piece (30).

5. The device according to claim 3 wherein said end piece (30') has wings bent by 30° to 40° between adjacent side wall members (27) which engage each other at the outlet of the device for moving the end pieces to their release positions.

6. A continuous moulding device of building materials comprising two pairs of drive sprockets (22) oppositely positioned at the inlet and the outlet of the device, a pair of chain conveyors (24) wound on said drive sprockets (22) and defining a forming run between the drive sprockets, the chain conveyors having a connecting part (24*a*) on each of their links, a series of bottom plates (26) each of which is connected to opposite connecting parts (24*a*) of said links, wherein each bottom plate defines spaced sides, a side wall member (27) pivotally connected to one of the sides of each said bottom plate to form a unit mould transversely, wherein each side wall member is pivotable relative to the bottom plate between a forming position on the forming run of the chain conveyors and a release position at the outlet of the device, end pieces (30, 30') connected to each said bottom plate (26) to contact the ends of each unit mould, wherein said end pieces extend between the side wall members of each unit mould and are movable between a forming position and a release position, wherein the side wall members and end pieces are in their forming positions on the forming run of the chain conveyors and are movable to their release positions as the chain conveyors are moved about the drive sprockets to release engagement with a product formed in said unit mould, and wherein a door frame moulding member 35 having patterns for reproducing wood grain is attached to said bottom plate 26.

7. A continuous moulding device of building materials comprising two pairs of drive sprockets (122) oppositely positioned at the inlet and outlet of the device, a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device.

8. A continuous moulding device of building materials comprising two pairs of drive sprockets (122) oppositely positioned at the inlet and outlet of the device, a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device, and wherein a second bottom member (129) is attached on an upper surface defined by said bottom member (128).

9. A continuous moulding device of building materials comprising two pairs of drive sprockets (122) oppositely positioned at the inlet and outlet of the device, a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device, and wherein said end pieces (130, 30') are in the form of a hinge and are attached on the bottom plate (126) and are biased by resilient springs (130*a*) to be in close contact with ends defined by the side wall members (127).

10. The device according to claim 9 wherein wires (130*b*) are provided to automatically move said end pieces (130) at the outlet of the device to their release positions, wherein one end of said wire is connected to the adjacent bottom plate (126) and the other end of said wire is connected to an upper corner defined by the end piece (130).

11. The device according to claim 9 wherein each said end piece (30') has wings bent by 30° to 40° inward from the ends of the side walls (127*a*, 127*b*) of the side wall members (127) which engage each other at the outlet of the device for moving the end pieces to their release positions.

12. A continuous moulding device of building materials comprising two pairs of drive sprockets (122) oppositely positioned at the inlet and outlet of the device, a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device, and wherein each said bottom member (128) is removably fixed to its respective bottom plate (126) by fixing means.

13. The device according to claim 12 wherein said fixing means comprises bolts (131) formed integrally with the bottom member (128) on a lower protruding surface defined by the bottom member, said bolts being arranged in at least two rows, bolt-receiving holes (126*a*) provided in the bottom plate (126), and nuts engaging with said bolts (131).

14. A continuous moulding device of building materials comprising two pairs of drive sprockets (122) oppositely positioned at the inlet and outlet of the device, a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device, wherein a second bottom member (128) is attached on an upper surface defined by said bottom member (128), and wherein an edge associated with the second bottom wall member and located adjacent the side wall of said side wall member (127) is rounded.

15. A continuous moulding device of building materials comprising two pairs of drive sprockets (122) oppositely positioned at the inlet and outlet of the device a pair of chain conveyors (124) wound on said drive sprockets (122) and defining a forming run between the drive sprockets, the chain conveyors having a connecting part (124*a*) on each of their links, a series of bottom plates (126) each of which is connected to opposite connecting parts (124*a*) of said links, side wall members (127) and bottom members (128) connected alternately to the bottom plates (126) and respectively forming side walls and bottoms of unit moulds, wherein movement of said chain conveyors over the drive sprocket at the outlet of the device separates the bottom members and side wall members, and end pieces (130, 30') connected to the bottom plates (126) to contact the ends of each unit mould, wherein said end pieces are movable between a forming position on the forming run of the chain conveyors and a release position at the outlet of the device wherein a second bottom member (129) is attached on an upper surface defined by said bottom member (128), and wherein patterns are formed on the surface of said second bottom member (129) for reproducing wood grain.

16. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls for each unit mould are formed integrally with the bottom wall of the unit mould and are resiliently movable relative to the bottom wall of the unit mould between a forming position on the forming run of the chain conveyors and a release position at the outlet of the device, and end pieces (230, 30') connected to each said bottom plate (226) to resiliently contact the ends of each unit mould, wherein said end pieces are movable relative to the bottom wall of the unit mould to which the end pieces are connected between a forming position on the forming run of the chain conveyors and a release position at the outlet of the device.

17. The device according to claim 16 wherein each unit mould of the moulding conveyor belt (210; 250) includes a joining part (210*d*) extending between side walls of adjacent unit moulds to connect adjacent unit moulds together.

18. The device according to claim 17 wherein an edge between each side wall (210*b*, 210*c*; 250*b*, 250*c*) and the bottom wall (210*a*; 250*a*) has a rounded shape.

19. The device according to claim 17 wherein adjacent side walls (210*b*, 210*c*; 250*b*, 250*c*) of the moulding conveyor belt (210, 250) are interconnected by a supporting member (235).

20. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls are formed integrally with the bottom wall and are resiliently movable between a forming position on the forming run of the chain conveyors and a release position at the outlet of the device, and end pieces (230, 30') connected to each said bottom plate (226) to resiliently contact the ends of each unit mould, wherein said end pieces are movable between a forming position on the forming run of the chain conveyors and a release position at the outlet of the device, and wherein said end pieces (230, 30') are in the form of a hinge and are attached on the bottom plate (226) and are biased by springs (230*a*) to be in close contact with ends defined by said side walls (210*b*, 210*c*; 250*b*, 250*c*).

21. The device according to claim 20 wherein wires (230*b*) are provided to automatically move said end pieces (230) at the outlet of the device to their release positions, wherein one end of said wire is connected to the adjacent bottom plate (226) and the other end of said wire is connected to an upper corner defined by the end piece (230).

22. The device according to claim 20 wherein said end piece (30') has wings bent by 30° to 40° between adjacent side walls (210*b*, 210*c*; 250*b*, 250*c*) which engage each other at the outlet of the device for moving the end pieces to their release positions.

23. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls are formed integrally with the bottom wall and are resiliently movable between a forming position on the forming run of the chain conveyors and a release position at the outlet of the device, and end pieces (230, 30') connected to each said bottom plate (226) to resiliently contact the ends of each unit mould, wherein said end pieces are movable between a forming position on the forming run of the chain conveyors and a release position at the outlet of the device, wherein each unit mould of the moulding conveyor belt (210; 250) includes a joining part (210*d*) extending between side walls of adjacent unit moulds to connect adjacent unit moulds together, and wherein said moulding conveyor belt (210, 250) is detachably connected to each bottom plate (226) by at least two rows of tight engaging means.

24. The device according to claim 23 wherein said tight engaging means comprises retainers (231*c*) having a shape of a ring, protrusions (231) integrally formed with said moulding conveyor belt (210, 250) and provided with a groove for said retainer to be inserted thereto, and protrusion receiving holes (231*b*) provided in said bottom plate (226).

25. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls are formed integrally with the bottom wall and are resiliently movable between a forming position on the forming run of the chain conveyors and a release position at the outlet of the device, and end pieces (230, 30') connected to each said bottom plate (226) to resiliently contact the ends of each unit mould, wherein said end pieces are movable between a forming position on the forming run of the chain conveyors and a release position at the outlet of the device, wherein each unit mould of the moulding conveyor belt (210; 250) includes a joining part (210*d*) extending between side walls of adjacent unit moulds to connect adjacent unit moulds together, and wherein patterns are formed on the surfaces of bottom wall (210*a*, 250*a*) and side walls (210*b*, 210*c*; 250*b*, 250*c*) of the moulding conveyor belt (210, 250) for reproducing decorative surfaces.

26. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls are formed integrally with the bottom wall and are resiliently movable between a forming position on the forming run of the chain conveyors and a release position at the outlet of the device, and end pieces (230, 30') connected to each said bottom plate (226) to resiliently contact the ends of each unit mould, wherein said end pieces are movable between a forming position on the forming run of the chain conveyors and a release position at the outlet of the device, and wherein a plurality of pins (241) are fixed through the moulding conveyor belt (210, 250) through pin inserting holes (246).

27. The device according to claim 26 wherein hinge attaching means (233) having screw holes (242) are embedded in the moulding conveyor belt (210, 250), and said pins (241) correspond to and are inserted into said screw holes (242).

28. A continuous moulding device of building materials comprising two pairs of drive sprockets (222) oppositely positioned at the inlet and the outlet of the device, a pair of chain conveyors (224) wound on said drive sprockets (222) and defining a forming run between the drive sprockets, the chain conveyors having a connecting part (224*a*) on each of their links, a series of bottom plates (226) each of which is connected to opposite connecting parts (224*a*) of said links, a moulding conveyor belt (210, 250) in which unit moulds are formed transversely and are connected to each other, each unit mould including spaced side walls and a bottom wall which cooperate to define a cavity, wherein the side walls are formed integrally with the bottom wall and are resiliently movable between a forming position on the forming run of the chain conveyors and a release position at the outlet of the device, and end pieces (230, 30') connected to each said bottom plate (226) to resiliently contact the ends of each unit mould, wherein said end pieces are movable between a forming position on the forming run of the chain conveyors and a release position at the outlet of the device, and wherein grooves (253*a*, 253*b*, 253*c*) for assembling rails are formed in said bottom wall (210*a*, 250*a*) of the moulding conveyor belt (210, 250).

29. A continuous moulding device, comprising:

a conveyor defining a forming run and trained about a drive member downstream of the forming run defining an outlet; and a series of unit moulds carried by the conveyor, each unit mould including a bottom wall and a pair of spaced side walls connected to the bottom wall defining a cavity for moulding a product therewithin, wherein each side wall is movable relative to the bottom wall to which the side wall is connected between a forming position on the forming run of the conveyor in which the side walls engage the product, and a release position at the discharge of the conveyor in which the side walls are disengaged from the product to enable the product to be discharged from the cavity.

30. The device of claim 29, further comprising a pair of end walls interconnected with the conveyor on either side of the bottom wall, wherein the end walls are movable between a forming position on the forming run of the conveyor in which the end walls engage the side walls, and a release position at the discharge of the conveyor in which the end walls are disengaged from the side walls.

31. A moulding device for a conveyor assembly including a pair of spaced drive members and a segmented conveyor extending therebetween and defining an upper run and a discharge at one of the drive members, comprising:

a series of bottom wall members fixed to the conveyor so as to face upwardly at the conveyor upper run; and a pair of spaced side walls movably mounted to each bottom wall defining a moulding cavity therebetween for movement between a forming position at the upper run of the conveyor for engaging a product formed within the cavity defined by the bottom wall and the spaced side walls, and a release position at the discharge of the conveyor in which the side walls are disengaged from the product to enable the product to be discharged from the cavity.

32. A moulded product moulded by the device according to claim 1.

33. A moulded product moulded by the device according to claim 7.

34. A moulded product moulded by the device according to claim 16.

* * * * *